United States Patent [19]

Weiss

[11] 4,231,030

[45] Oct. 28, 1980

[54] SAFETY DEVICE FOR A CRIB

[76] Inventor: Mary G. Weiss, 530 S. Ocean Blvd., Palm Beach, Fla. 33480

[21] Appl. No.: 6,261

[22] Filed: Jan. 23, 1979

[51] Int. Cl.[3] ..... G08B 21/00

[52] U.S. Cl. ..... 340/686; 200/61.74; 200/61.81; 340/573; 362/130

[58] Field of Search ..... 340/666, 686, 573; 200/61.71, 61.74, 61.75, 61.81; 362/130, 802; 307/116

[56] References Cited

U.S. PATENT DOCUMENTS

| | | | |
|---|---|---|---|
| 1,901,589 | 3/1933 | Fullmer | 340/686 X |
| 2,435,514 | 2/1948 | Ross | 340/686 X |
| 2,734,104 | 2/1956 | Gollhofer | 340/686 X |
| 4,067,005 | 1/1978 | Levy et al. | 340/573 |
| 4,139,845 | 2/1979 | Washburn | 340/686 |

*Primary Examiner*—John W. Caldwell, Sr.
*Assistant Examiner*—Joseph E. Nowicki
*Attorney, Agent, or Firm*—Barry L. Haley; Eugene F. Malin; Philip R. Wadsworth

[57] ABSTRACT

A safety device for a crib which provides an indicating light or alarm to alert a person to the fact that the crib gate is in a down position, to prevent the leaving of a child in a crib with the gate down and to insure that the crib gate is up and locked whenever the supervising person leaves the area or room. The device includes an illumination element and/or audible beeper having a switch that engages a structural portion of the crib gate when the gate is in a down position. The device may be readily installed on a conventional crib and may also provide subdued background lighting to allow observation of a child in the crib without disturbing the infant in the crib.

1 Claim, 6 Drawing Figures

SAFETY DEVICE FOR A CRIB

BACKGROUND OF THE INVENTION

This invention relates generally to a safety device for use with an occupied baby crib to insure that the crib gate is up and locked when a person in attendance or supervisor leaves the area or room, and specifically to an illumination and/or audible buzzer device that affixes to the leg of the crib that includes an actuating switch that engages a portion of the crib gate frame when the gate is in the down position to provide illumination, or audible sound indicative of the fact that the crib gate is down.

The use of cribs for allowing children to sleep safely is well known, the conventional crib having a vertical side member that is adjustable from an up-locked position that safely houses the child to a down position which allows those in supervision of the child ready access to the child. The purpose of providing that the crib gate be locked in an up position is obviously to protect the child and to keep the child from falling or otherwise exiting the crib itself. Oftentimes, however, the crib gate is inadvertently or negligently left in a down position, exposing the infant therein to potential injury or harm should the infant position himself near the edge of the crib with the gate being down.

The present invention eliminates potential harm or injury that could be experienced by the child from exiting the crib by providing a safety device that functions as a positive indication that the crib gate is down, while at the same time providing background illumination for night time activity to allow observation of the child without arousing the child with bright lights.

BRIEF DESCRIPTION OF THE INVENTION

A crib gate safety device for providing a positive indication that a crib gate is in a down position to prevent the inadvertent leaving of the crib gate down comprising an illumination means, a power source, and a switch connected to the illumination means and the power source which is spring biased in the off position, and a bracket connected to the illumination means and to a supporting leg of the crib, the illumination means and switch being positioned or mounted on the crib such that when the crib gate is in the down position, the switch on the illumination means will be activated causing the device to illuminate with the crib gate down.

In one embodiment, a mounting bracket is used. The device includes a housing, a low voltage DC battery positioned in said housing, a spring-mounted switch connected through one portion of the housing, a light bulb connected in communication with the battery and a circuit connecting the lightbulb and battery to the switch when the switch is depressed by a down position of the crib gate. The device may be mounted on the lower portion of one of the crib gate legs such that illumination is directed downwardly, which provides a positive indication to the supervisor that the crib gate is down by observation of the illuminated light bulb while at the same time providing a subtle background lighting sufficient to give proper observation of an infant disposed in a crib without providing a glaring light directly over the infant to prevent disturbing of the infant. To operate the device, the crib will function in its normal manner such that the crib gate is moveable from its upper locked position to the down position to allow access by the supervisor to the infant as desired. In the down position, the light will be illuminated throughout the time period as long as the crib gate is down. Should the supervisor attempt to leave the area or room with the crib gate down, illumination will readily tell the supervisor. Once the crib gate is moved to the up-locked position, the light is turned off and the crib gate locked. Although shown in a position beneath the crib gate, the device could be positioned at various locations on the crib in cooperation with movement of the crib gate. Further, the device could be positioned such that the light will illuminate at anytime when the crib gate is not fully up and locked. In the alternative or in conjunction with the illumination means, an audible buzzer could be utilized as the indication of the crib gate position.

In yet another embodiment, the device could be integrally formed with the crib such that the switch, the light and power source are mounted and recessed within one of the structural members of the crib or the crib gate.

It is an object of this invention to provide a safety device for use with a crib to provide an indicational warning that the crib gate is not in the fully up-locked position.

It is another object of this invention to provide a safety indicating device for use with a crib that itself does not add hazard to the infant's environment while still maintaining a safety illumination.

But yet still another object of this invention is to provide a portable, readily mounted safety device that may be affixed to a conventional crib that can be utilized to provide an indication or warning that the crib gate is not in its fully locked upper position.

In accordance with these and other objects which will be apparent hereinafter, the instant invention will now be described with particular reference to the accompanying drawings.

BRIEF DESCRIPTION OF THE DRAWINGS

Referring now to the drawings and especially FIGS. 1 and 2, the instant invention is shown generally at 10 mounted on a crib leg 12, the crib being conventional and having a gate 14 (shown in the raised, locked position) which moves relative to the crib body on rods 16 which allow it to slide up and down. Any particular conventional crib having a moveable gate that moves vertically can be utilized with the instant invention. When the crib gate is moved to a down position, the lower frame member of gate 14 engages a switch 18 connected into housing 20 which also has a lightbulb 22 covered by protective translucent dome 30 which connects threadably to the housing 20. Inside the housing 20 is a battery and switch system which is discussed below. The housing 20 is mounted to a crib leg 12 by a bracket 24 having connectors 26 and 28 disposed at each end. As shown in FIG. 2, the gate is in the down position with the switch depressed, causing the device to illuminate. The spring loaded switch 18 illuminates the device only when depressed.

FIG. 3 shows the device in prospective with the bracket 24 firmly holding the housing 20 to the crib leg 12.

FIG. 4 shows the mounting bracket 24 which is a pair of symmetrical plates which are adaptable to different sized cribs including connectors 26 and 28 which may be threaded or otherwise to connect the two symmetrical plates together to effect a rigid mounting.

FIG. 5 shows the operation of the device including the switch 18 that is spring loaded by spring 34 to the off position. At the end of switch 18 is a metal conductive plate 38. An electrical connector 36 which is conductive, is connected to the base of the light bulb 22 and to the battery terminal of battery 32. The spring 34 is also conductive such that when switch 18 is depressed which allows plate 38 to engage the circuit connector 36, the circuit will be completed from the upper battery terminal to the light bulb causing the light bulb to illuminate. The protective dome 30 may be threadably attached to housing 20 to allow removal to replace the bulb. As long at the crib gate is depressed against switch 18, the device will illuminate. Once the crib gate is disengaged from the switch, then the device will shut off.

FIG. 6 shows a circuit diagram having battery 32 connected in series with bulb 22 and switch 36.

Figure 1:
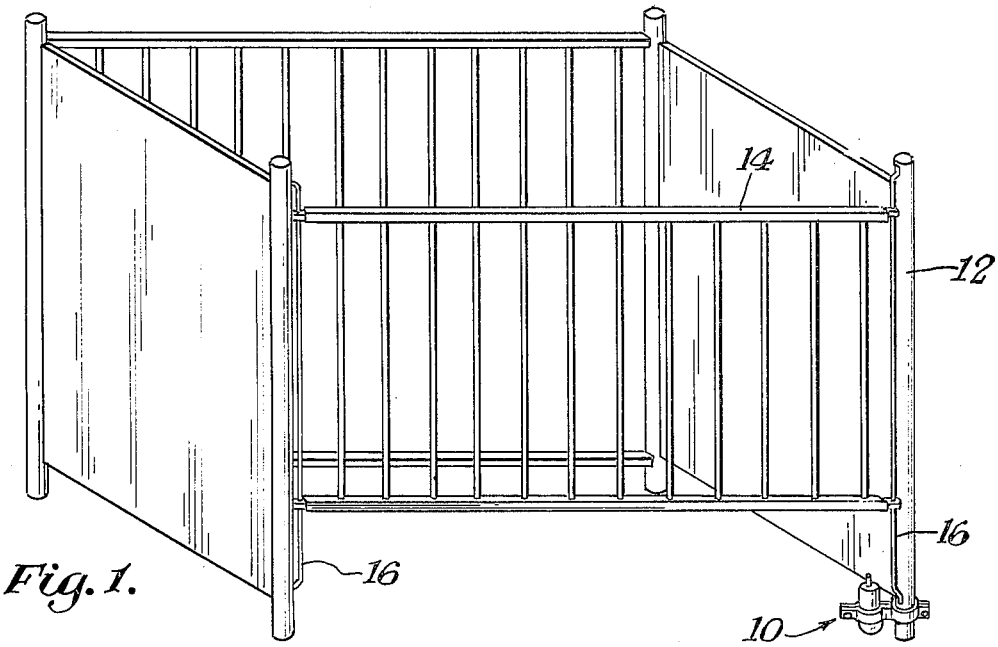
FIG. 1 is a perspective view of a conventional crib with the instant invention mounted thereon.
Figure 2:
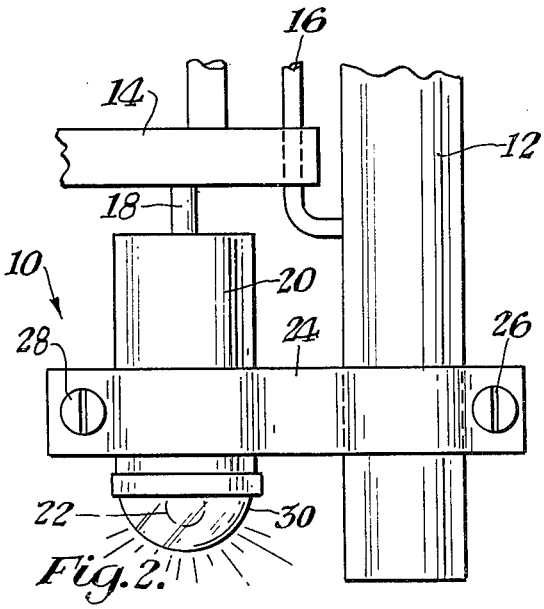
FIG. 2 is a fragmentary side elevational view of the instant invention in its operating position.
Figure 3:
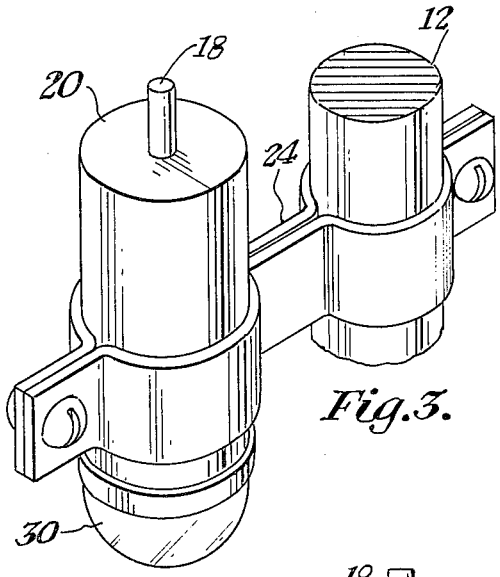
FIG. 3 shows a perspective view of the instant invention as mounted on a crib leg which is partially cut away.
Figure 4:
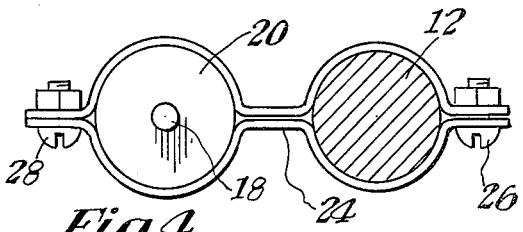
FIG. 4 is a top plan view of the instant invention as mounted on a crib leg which is shown in cross-section.
Figure 6:
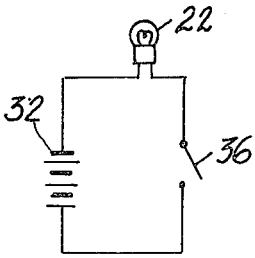
FIG. 6 is a schematic diagram of an electrical circuit utilized with the instant invention.
Figure 5:
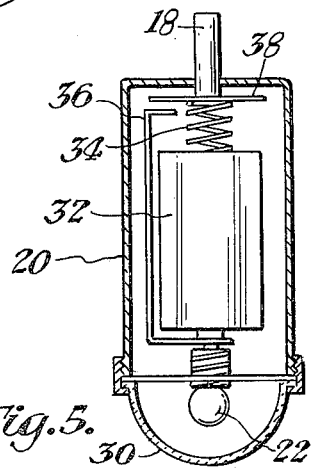
FIG. 5 is a side elevational view in cross-section showing the circuit of the instant invention.

In operation, the device is mounted such that a switch will engage some portion of the crib gate when it is not in a upper locked position. This will insure that whenever the gate is not fully up and locked, a supervisor or other person in the room will be provided with a visual indication of this fact.

Other types of indicating devices could be used such as a small beeping sound or the like that would be useful for daytime. Individual switches can be used for the light and audio indicators for selective operation of each indicator.

The device could be integrally formed with the construction of the crib such that the light bulb power source and switch could be mounted within the leg or gate of the crib with a switch provided when the gate is not down and locked.

The instant invention has been shown and described herein in what is considered to be the most practical and preferred embodiments. It is recognized however, that departures may be made therefrom within the scope of the invention and that obvious modifications will occur to a person skilled in the art.

What I claim is:

1. A safety device for an infant's crib having a crib gate and useful in combination thereof to provide a visual indication and background illumination when the crib gate is in a down, unlocked position, comprising:

a housing;

an electrically actuated light source mounted within said housing;

an electrical power source mounted within said housing and connected to said light source;

a mechanically actuated spring biased switch mechanically connected through said housing and electrically connected between said power source and said light source, said spring biasing the switch in an off position such that when said switch is mechanically moved from said bias off position to a second position said light source will be actuated, said light source being disposed at one end of said housing and said switch being disposed at the opposite end of said housing; and a bracket having the first portion connected to said housing and a second portion connected to a crib leg adjacent said movable gate, said housing being disposed relative to said crib gate whereby said switch is actuated whenever said crib gate is in a down position.

* * * * *